US011590759B2

(12) United States Patent
Nanjo et al.

(10) Patent No.: US 11,590,759 B2
(45) Date of Patent: Feb. 28, 2023

(54) LIQUID CONTAINER AND LIQUID EJECTION APPARATUS

(71) Applicant: CANON KABUSHIKI KAISHA, Tokyo (JP)

(72) Inventors: Tatsuo Nanjo, Kanagawa (JP); Hiroki Hayashi, Kanagawa (JP); Keisuke Kouno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/483,368

(22) Filed: Sep. 23, 2021

(65) Prior Publication Data

US 2022/0097388 A1 Mar. 31, 2022

(30) Foreign Application Priority Data

Sep. 28, 2020 (JP) ..... JP2020-162079

(51) Int. Cl.
*B41J 2/175* (2006.01)

(52) U.S. Cl.
CPC ..... *B41J 2/1752* (2013.01); *B41J 2/17503* (2013.01); *B41J 2/17509* (2013.01); *B41J 2/17513* (2013.01); *B41J 2/17553* (2013.01); *B41J 2/17556* (2013.01); *B41J 2/17596* (2013.01)

(58) Field of Classification Search
CPC .... B41J 2/175; B41J 2/17503; B41J 2/17506; B41J 2/17509; B41J 2/17513; B41J 2/1752; B41J 2/17523; B41J 2/17553; B41J 2/17556; B41J 2/17596
See application file for complete search history.

(56) References Cited

U.S. PATENT DOCUMENTS

| | | | | |
|---|---|---|---|---|
| 6,443,567 | B1 | 9/2002 | Hayashi et al. | 347/85 |
| 6,474,797 | B2 | 11/2002 | Kurata et al. | 347/85 |
| 6,505,923 | B1 | 1/2003 | Yamamoto et al. | 347/85 |
| 6,511,167 | B1 | 1/2003 | Kitabatake et al. | 347/86 |
| 6,530,654 | B2 | 3/2003 | Kitabatake et al. | 347/86 |
| 6,629,758 | B2 * | 10/2003 | Okamoto | B41J 2/17596 347/85 |
| 6,637,872 | B2 * | 10/2003 | Ara | B41J 2/17596 347/85 |
| 6,692,115 | B2 | 2/2004 | Sanada et al. | 347/85 |
| 6,702,427 | B2 | 3/2004 | Shimizu et al. | 347/50 |
| 6,827,431 | B2 | 12/2004 | Kitabatake et al. | 347/86 |

(Continued)

FOREIGN PATENT DOCUMENTS

JP 2018-161876 10/2018

*Primary Examiner* — Anh T Vo
(74) *Attorney, Agent, or Firm* — Venable LLP

(57) ABSTRACT

A liquid container is removably mountable into the apparatus body of a liquid ejection apparatus. The liquid container comprises a liquid storage chamber equipped with an air intake hole and a liquid supply port, for storing liquid and a valve unit having a sealing member and an urging member. The urging member is arranged so as to be at least partly rotationally movable and the urging member has urging force for urging the sealing member in the direction of making the sealing member abut the air intake hole. The sealing member is rotationally movable between a position of abutting and closing the air intake hole and a position separated from the air intake hole so as to open the air intake hole in response to a rotary motion of the urging member.

15 Claims, 6 Drawing Sheets

(56) References Cited

U.S. PATENT DOCUMENTS

| | | | | |
|---|---|---|---|---|
| 6,971,741 | B2 | 12/2005 | Nanjo et al. | 347/85 |
| 6,997,548 | B2 | 2/2006 | Matsuo et al. | 347/86 |
| 7,118,194 | B2 | 10/2006 | Matsuo et al. | 347/49 |
| 7,165,829 | B2 | 1/2007 | Hayashi et al. | 347/49 |
| 7,207,159 | B2 | 4/2007 | Nanjo et al. | 53/492 |
| 7,303,090 | B2 | 12/2007 | Nanjo et al. | 220/360 |
| 8,011,768 | B2 | 9/2011 | Hayashi et al. | 347/86 |
| 8,439,491 | B2 | 5/2013 | Hayashi et al. | 347/86 |
| 8,485,642 | B2 | 7/2013 | Hayashi et al. | 347/49 |
| 9,724,929 | B2 | 8/2017 | Yoshii et al. | B41J 2/1752 |
| 10,160,222 | B2 | 12/2018 | Shiba et al. | B41J 2/17566 |
| 10,391,776 | B2 | 8/2019 | Hayashi et al. | B41J 2/17513 |
| 10,675,882 | B2 | 6/2020 | Shiba et al. | B41J 2/17566 |
| 2018/0272741 | A1 | 9/2018 | Kobayashi et al. | B41J 2/19 |

* cited by examiner

LIQUID CONTAINER AND LIQUID EJECTION APPARATUS

BACKGROUND OF THE INVENTION

Field of the Invention

The present invention relates to a liquid container and a liquid ejection apparatus.

Description of the Related Art

Liquid ejection apparatus such as inkjet recording apparatus have one or more than one liquid container that contain liquid to be supplied to the liquid ejection head of the apparatus and the liquid container or each of the liquid containers is equipped with an air communication port for taking air into the liquid container in order to compensate the amount of liquid that has been supplied to the liquid ejection head and hence decreased from the original amount. Normally, such a liquid container is removably fitted to the apparatus body. Before the liquid container is fitted to the apparatus body, particularly while the liquid container is being transported, the liquid contained in the liquid container can fly away or otherwise leak out from the liquid container to the outside through the air communication port.

Japanese Patent Application Laid-Open No. 2018-161876 proposes a liquid container (liquid cartridge) having a valve mechanism arranged between the liquid storage chamber and the air communication port of the liquid container. The liquid cartridge comprises a first storage chamber, which is a liquid storage chamber, an air communication flow path having a communication hole, which is an air communication port, and a through hole that allows the first storage chamber and the air communication flow path to communicate with each other. The valve mechanism has a valve body for closing and opening the through hole, a coil spring for urging the valve body and a lever that is rotationally movable so as to move the valve body against the urging force of the coil spring. Before the liquid cartridge is fitted to the apparatus body, the lever, whose move is restricted by a stopper, holds the valve body to its position of closing the through hole against the urging force of the coil spring. Therefore, the liquid in the liquid container is prevented from flying away or otherwise leaking out from the liquid container to the outside through the air communication port. In the process of mounting the liquid cartridge into the apparatus body, as a protruding plate arranged in the apparatus body abuts and turns the lever, the valve body that is urged by the coil spring is driven to move to its open position and open the through hole. Then, as a result, the first storage chamber and the air communication flow path are allowed to communicate with each other to make it possible for the first storage chamber to take outer air into the first storage chamber by way of the communication hole and the air communication flow path.

SUMMARY OF THE INVENTION

With the arrangement described in Japanese Patent Application Laid-Open No. 2018-161876, the valve mechanism is made to include a valve body, a coil spring, a lever and so on and additionally requires a stopper and a protruding plate. In short, the arrangement described in Japanese Patent Application Laid-Open No. 2018-161876 requires a large number of component parts and the process of manufacturing it is a complex and cumbersome one and entails high manufacturing cost.

Therefore, the object of the present invention is to provide a liquid container that can effectively minimize the risk that liquid flies away or leaks out from it to the outside by way of the air communication port thereof and entails only a simple manufacturing process and low manufacturing cost.

A liquid container that is removably mountable into the apparatus body of a liquid ejection apparatus according to the present invention comprises: a liquid storage chamber equipped with an air intake hole and a liquid supply port, for storing liquid; and a valve unit having a sealing member and an urging member; the urging member being arranged so as to be at least partly rotationally movable, the urging member having urging force for urging the sealing member in the direction of making the sealing member abut the air intake hole; the sealing member being rotationally movable between a position of abutting and closing the air intake hole and a position separated from the air intake hole so as to open the air intake hole in response to a rotary motion of the urging member.

Further features of the present invention will become apparent from the following description of exemplary embodiments with reference to the attached drawings.

DESCRIPTION OF THE EMBODIMENTS

Now, the present invention will be described in greater detail below by referring to the accompanying drawings.

First Embodiment (Basic Structure of Liquid Supply Mechanism)

Figure 1:
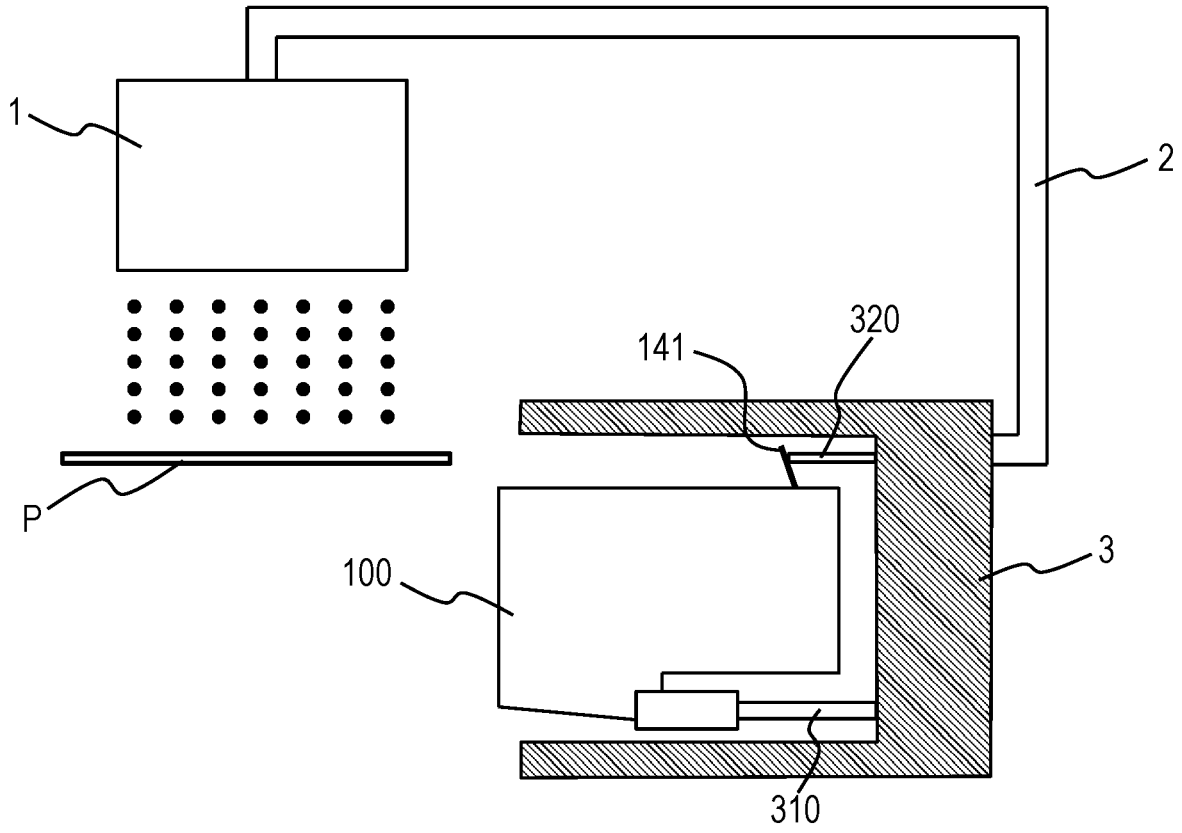
FIG. 1 is a schematic illustration of a principal part of the first embodiment of liquid ejection apparatus according to the present invention.

FIG. 1 schematically illustrates a principal part of the first embodiment of liquid ejection apparatus according to the present invention. This first embodiment of liquid ejection apparatus according to the present invention is an inkjet recording apparatus comprising a liquid ejection head (recording head) 1 for ejecting liquid and a liquid tank 100, which is a liquid container containing liquid such as ink to be supplied to the liquid ejection head 1. The liquid ejection head 1 and the liquid tank 100 are connected to each other by way of a flexible tube 2. Although not shown, the liquid ejection head 1 is mounted into a movable carriage. The liquid ejection head 1 is allowed to reciprocate so as to take different positions, all of which are located vis-à-vis the recording medium P shown in FIG. 1, with the tube 2 drawn by the liquid ejection head 1 so as to shift its position in order to accommodate the move of the lead ejection head 1. More specifically, the liquid tank 100 is mounted into a holder arranged in the apparatus body and rigidly secured by the apparatus body. As liquid is ejected from the liquid ejection head 1 toward the recording medium P and the liquid in the liquid ejection head 1 is consumed, liquid is supplied from the liquid tank 100 to the liquid ejection head 1 by way of the tube 2 in order to compensate the consumed liquid.

(Basic Structure of Liquid Tank)

Figure 2:
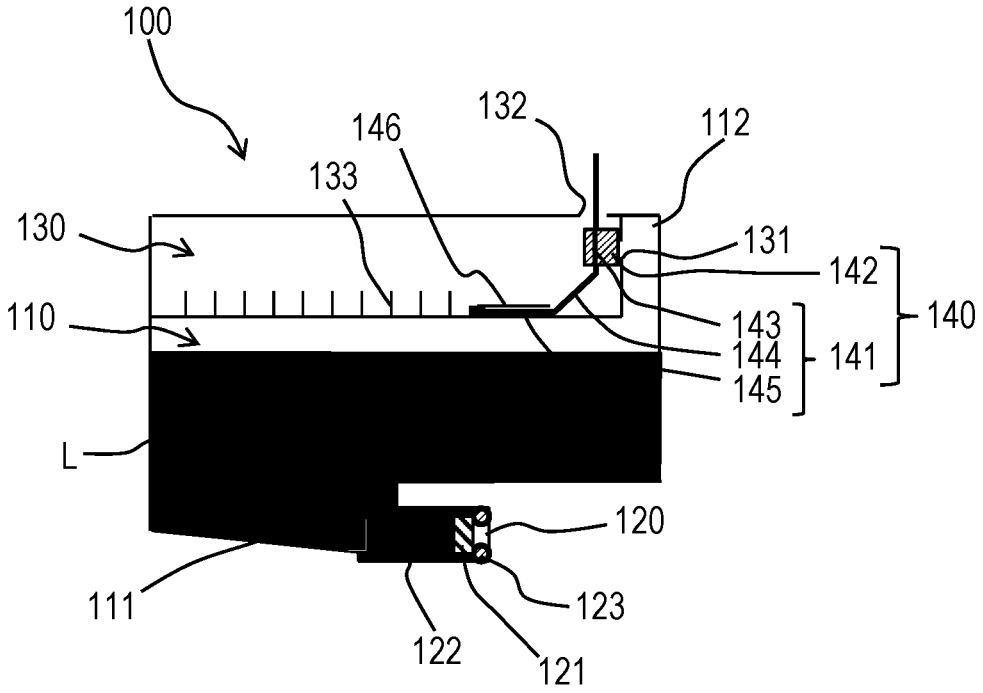
FIG. 2 is a schematic cross-sectional view of the first embodiment of liquid tank according to the present invention.

FIG. 2 is a schematic cross-sectional view of the liquid tank 100 of this embodiment. The liquid tank 100 principally has a liquid storage chamber 110 for storing liquid L and an air communication chamber 130 that does not store any liquid but contains air. The liquid storage chamber 110 and the air communication chamber 130 are held in communication with each other by way of an air intake hole 131 for taking air into the liquid storage chamber 110. The air communication chamber 130 is equipped with an air communication port 132 that is held open to the outside. The liquid storage chamber 110 is equipped with a liquid supply port 120 and one of the opposite ends of the tube 2 is connected to the liquid supply port 120 as shown in FIG. 1. As liquid is supplied from the liquid storage chamber 110 to the liquid ejection head 1 by way of the tube 2, negative pressure arises in the inside of the liquid storage chamber 110. However, the internal pressure of the liquid storage chamber 110 is held to a constant pressure level because air is taken into the liquid storage chamber 110 from the air communication chamber 130 by way of the air intake hole 131. Thus, liquid is satisfactorily supplied from the liquid tank 100 to the liquid ejection head 1 in the above-described manner. Each of the component parts of the liquid tank 100 will be described in greater detail hereinafter.

(Liquid Storage Chamber)

The liquid storage chamber 110 stores and keeps the liquid to be supplied to the liquid ejection head 1. The liquid storage chamber 110 is equipped at the bottom section thereof with a recess 111 that vertically downwardly extends from the bottom section. The liquid supply port 120 is arranged at the recess 110. At least part of the bottom surface of the recess 111 is downwardly inclined toward the liquid supply port 120 so as to allow the liquid in the liquid storage chamber 110 to flow with ease toward the liquid supply port 120. Then, as a result, when the amount of liquid remaining in the liquid storage chamber 110 is reduced, a situation where at least part of the liquid remaining in the liquid storage chamber 110 stays in the bottom section of the liquid storage chamber 110 and does not move toward the liquid supply port 120 is suppressed from taking place. The liquid storage chamber 110 is provided with a protruding part 112 that extends vertically upwardly from it. The air communication chamber 130 is arranged vertically right on a major part of the liquid storage chamber 110 so as to be located side by side relative to the protruding part 112. As far as this letter of specification is concerned, the expression of "vertical direction" refers to the vertical direction observed in the situation where the liquid tank 100 is properly fitted to the apparatus body. Note that, in each of the drawings, the liquid storage chamber 110 is not completely filled with liquid L and air exists in a vertically upper part of the liquid storage chamber 110.

The liquid storage chamber 110 is provided at a position located close to the liquid supply port 120 with a valve. The valve includes a resin-made valve body 121, a metal-made valve spring 122 and a rubber-made annular joint seal 123. The joint seal 123 is fitted to the liquid supply port 120. Before the liquid tank 100 is mounted into the apparatus body, the valve body 121, which is being pressed by the urging force of the valve spring 122, is held in tight contact with the joint seal 123 and the liquid supply port 120 is closed by the joint seal 123 and the valve body 121.

(Air Communication Chamber)

Now, the air communication chamber 130 will be described below in greater detail. As pointed out earlier, the air communication chamber 130 is arranged vertically right on the principal part of the liquid storage chamber 110. The air communication chamber 130 is equipped with the air communication port 132 that is held open to the outside. The wall that separates and is shared by the air communication chamber 130 and the protruding part 112 of the liquid storage chamber 110 is equipped with the air intake hole 131 and the air communication chamber 130 and the liquid storage chamber 110 held in communication with each other by way of the air intake hole 131. As the liquid in the inside of the liquid storage chamber 110 is consumed, external air (atmosphere) that exists around the liquid tank 100 gets into the inside of the air communication chamber 130 by way of the air communication port 132 and then enters the liquid storage chamber 110 through the air intake hole 131.

The valve unit 140 is arranged in the inside of the air communication chamber 130. The valve unit 140 includes as principal components thereof a metal-made leaf spring (urging member) 141 and a rubber-made sealing member (elastic member) 142. The leaf spring 141 includes a first section 143, a second section 144 and a third section 145 that sequentially extend in the above mentioned order and any two neighboring ones of the three sections that are connected to each other form an angle between them. The first section 143 extends in the vertical direction and the third section 145 extends in a direction that is orthogonal relative to the vertical direction (in a horizontal direction). The second section 144 extends in an oblique direction and takes the role of linking the first section 143 and the third section 145. The sealing member 142 is fitted to the first section 143 at a position where it can abuts the air intake hole 131. The third section 145 is rigidly secured in position as it is hung to the hook 146 arranged on the bottom surface of the air communication chamber 130. So long as the third section 145 is rigidly secured in position, the leaf spring 141 urges the first section 143 in the direction directed toward the protruding part 112 of the liquid storage chamber 100 with its spring force (urging force) and hence the sealing member 142 is pressed against the wall to close the air intake hole 131. A front end part of the first section 143 projects to the outside through the air communication port 132. Since the air communication port 132 is sufficiently large relative to the cross section of the leaf soring 141, the air communication port 132 is held open to the outside without being closed by the leaf spring 141. The first section 143 of the leaf spring 141 is movable in the air communication port 132 in the thickness direction of the first section 143. The valve unit 140 of this embodiment has only two parts including the sealing member 142 that abuts the air intake hole 131 and the leaf spring 141, which is the urging member for urging the sealing member 142 in the direction of making the sealing member 142 abut the air intake hole 131. In other words, the valve unit 140 has only a minimal number of parts necessary for making the valve operate properly.

The air communication chamber 130 is equipped in the inside thereof with ribs 133. Therefore, if liquid flows from the liquid storage chamber 110 into the air communication chamber 130 by way of the air intake hole 131, the liquid can be trapped among the ribs 133 due to the capillary force that arises among the ribs 133. Then, as a result, the amount of liquid that can leak out from the air communication port 132 to the outside or otherwise become freely movable can be minimized.

(Holder)

The holder 3 that is arranged on the apparatus body to receive the liquid tank 100 has a profile adapted to contain the liquid tank 100 in the inside thereof as shown in FIG. 1. The holder 3 is equipped with a joint needle 310 to be pushed into the liquid tank 100 through the liquid supply port 120 and a pressing portion 320 adapted to be capable of pressing the first section 143 of the leaf spring 141. The joint needle 310 is a hollow needle having an opening 311 (see FIGS. 3A and 3B) at the front end thereof. The joint needle 310 is linked to the tube 2 and operates as the tail end part of the liquid supply system of the apparatus body side.

(Operation of Mounting and Dismounting Liquid Tank)

Figure 3A:
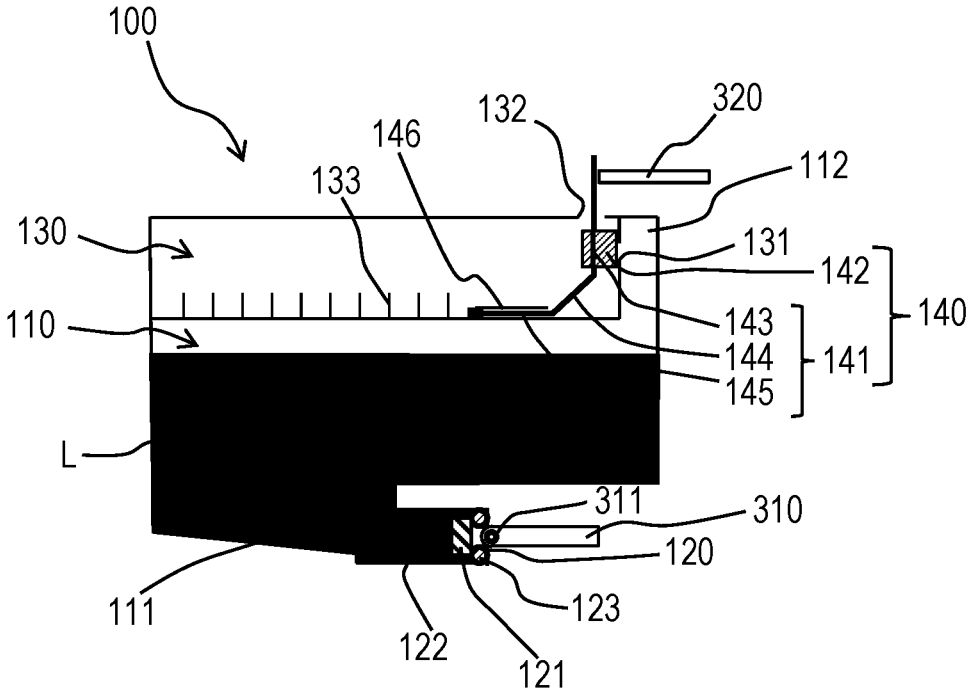
FIGS. 3A and 3B are schematic cross-sectional views of the liquid tank of FIG. 2, illustrating the sequence in which it is fitted to a liquid ejection apparatus.
Figure 3B:
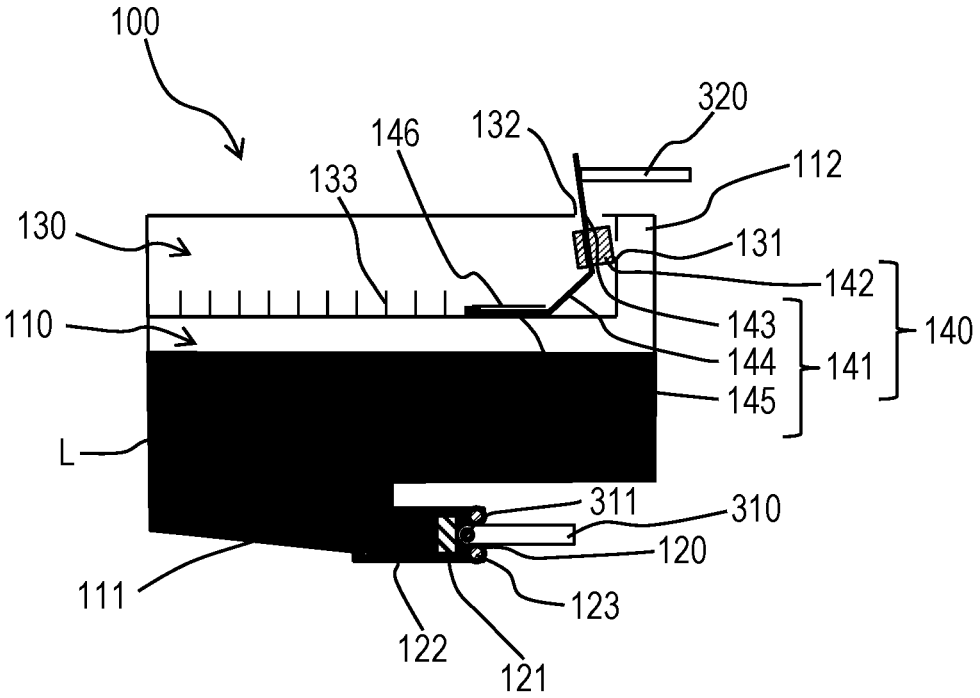

Now, the operation of mounting the liquid tank 100 having the above-described configuration into the holder 3 of the apparatus body will be described below. FIGS. 3A and 3B schematically and sequentially illustrate the operation of mounting the liquid tank 100 into the holder 3 of the apparatus body. Note that FIGS. 3A and 3B are cross-sectional views showing only the liquid tank 100 and the joint needle 310 and the pressing potion 320 of the holder 3. FIG. 3A is a cross-sectional view, illustrating the process of mounting the liquid tank 100 into the holder 3. It shows a situation immediately before the pressing portion 320 of the holder 3 abuts the leaf spring 141 of the liquid tank 100. FIG. 3B is a cross-sectional view, illustrating a situation where the liquid tank 100 has completely been mounted into the holder 3.

As shown in FIG. 2, before the liquid tank 100 is mounted into the holder 3, the air intake hole 131 is closed and hermetically sealed by the sealing member 142 and hence the liquid storage chamber 110 is held in a sealed condition. The liquid tank 100 is transported (for distribution) in this condition and hence there does not arise any risk that the liquid in the liquid storage chamber 110 flies away or otherwise leaks out to the outside of the liquid tank 100.

The liquid tank 100 as shown in FIG. 2 is then mounted into the holder 3. The operation of mounting the liquid tank 100 into the holder 3 is conducted in such a condition that the side of the liquid tank 100 where the protruding part 112 of the liquid storage chamber 110 of the liquid tank 100 is located is made to face the side of the holder 3 where the joint needle 310 and the pressing portion 320 are arranged. In this condition, the joint needle 310 faces the liquid supply port 120 and the pressing portion 320 faces the first section 143 of the leaf spring 141. On the way of mounting the liquid tank 100 into the holder 3, the joint needle 310 of the holder 3 is brought close to the joint seal 123 and the valve body 121 that close the liquid supply port 120 of the liquid tank 100 as shown in FIG. 3A.

As the liquid tank 100 is brought further close to the holder 3 in the condition where the pressing portion 320 is held close to the first section 143 of the leaf spring 141 as shown FIG. 3A, the pressing portion 320 presses the first section 143 of the leaf spring 141 to elastically deform the leaf spring 141 as shown in FIG. 3B. More specifically, since the third section 145 is rigidly secured to the hook 146, the leaf spring 141 rotates around a point located in the vicinity of the connection point of the second section 144 and the third section 145. As the leaf spring 141 rotates, the sealing member 142 fitted to the first section 143 is moved away from the air intake hole 131, which air intake hole 131 is then freed and becomes open. As a result, the liquid storage chamber 110 and the air communication chamber 130 are brought into communication with each other by way of the air intake hole 131. Therefore, then air can be taken into the liquid storage chamber 110 from the air communication port 132 by way of the air communication chamber 130 and the air intake hole 131.

After the liquid storage chamber 110 and the air communication chamber 130 are brought into communication with each other in the above-described manner, the joint needle 310 presses the valve body 121 against the urging force of the valve spring 132 in the liquid supply port 120. Then, as a result, the valve body 121 is moved away from the joint needle 123 and the opening 311 at the front end of the joint needle 310 gets deep into the liquid supply port 120. Then, the liquid in the liquid storage chamber 110 flows into the inside (the hollow part) of the joint needle 310 from the opening 311. Since the liquid storage chamber 110 communicates with the liquid ejection head 1 by way of the joint needle 310 and the tube 2, the liquid in the liquid storage chamber 110 becomes suppliable to the liquid ejection head 1. At this point, the outer peripheral surface of the joint needle 310 is tightly held in contact with the inner peripheral surface of the joint seal 123 to prevent liquid from leaking out from between the outer peripheral surface of the joint needle 310 and the inner peripheral surface of the joint seal 123. In this way, the operation of mounting the liquid tank 100 into the holder 3 is completed as shown in FIG. 3B.

When removing the liquid tank 100 that has been mounted into the holder 3 in the above-described manner, an operation that goes reversely relative to the above-described mounting operation is executed. If the liquid tank 100 still contains liquid to some extent when it is removed from the holder 3, the joint needle 310 is pulled out from the liquid supply port 120 and, at the same time, the valve body 121 is brought into tight contact with the joint seal 123 by the urging force of the valve spring 122. Then, as a result, the connection between the liquid storage chamber 110 and the tube 2 and the liquid ejection head 1 by way of the joint needle 310 is cut off and the liquid supply port 120 is closed. Additionally, the pressing portion 320 is driven in the direction of moving away from the leaf spring 141 and the first section 143 and the second section 144 of the leaf spring 141 are driven to rotate and return to their initial positions due to their resilience so that the sealing member 142 fitted to the first section 143 comes to close the air intake hole 131. Thus, in the operation of dismounting the liquid tank 100 from the holder 3, the liquid tank 100 is removed from the holder 3 and, of the liquid storage chamber 110 of the liquid tank 100 that is removed from the holder 3 by the operation that goes reversely relative to the above-described mounting operation, the liquid supply port 120 is then closed by the valve body 121 and the joint seal 123 and the air intake hole 131 is closed and sealed by the sealing member 142. Therefore, if the liquid tank 100 is forced to change its posture and/or it is subjected to an impact, the liquid in the inside of the liquid storage chamber 110 would not fly away to the outside or otherwise leak out from the liquid storage chamber 110 of the liquid tank 100.

If the liquid in the liquid storage chamber 110 leaks out from it by way of the air intake hole 131 because the apparatus body is forced to change its posture in the condition where the liquid tank 100 is mounted into the holder 3, the liquid that leaks out from the liquid storage chamber 110 then gets into the air communication chamber 130. In this embodiment, the air communication port 132 and the air intake hole 131 are arranged at the respective walls of the air communication chamber 130 that differ from each other. More specifically, the air communication port 132 is arranged at the wall that is located vertically right on the air communication chamber 130 and extends in directions that are orthogonal relative to the vertical direction (ceiling wall), whereas the air intake hole 131 is arranged at one of the walls of the liquid storage chamber 110 that extend in the vertical direction (lateral walls). In other words, the surface where the intake hole 131 is arranged and the surface where the air communication port 132 is arranged are substantially perpendicular relative to each other. Therefore, the liquid that leaks out from the air intake hole 131 never directly gets to the air communication port 132 but only enters the air communication chamber 130. As pointed out earlier, the ribs 133 are arranged in the air communication chamber 130 and hence the liquid that leaks out and enters the air communication chamber 130 is trapped by the ribs 133 and therefore can hardly get to the air communication port 132. The net result will be that the liquid in the liquid tank 100 is prevented from flying away or otherwise leaks out from the liquid tank 100 to the outside.

(Characteristic Features of this Disclosure)

One of the characteristic features of this disclosure is that the urging member that presses the sealing member 142 against the air intake hole 131 is a leaf spring 141. The leaf spring 141 is arranged so as to be at least partly rotationally movable and exerts urging force for urging the sealing member 142 in the direction of forcing the sealing member 142 to abut the air intake hole 131. More specifically, a part of the leaf spring 141 (the third section 145) is rigidly secured in position, while the remaining part (including the first section 143 and the second section 144) is held rotationally movable and the sealing member 142 is fitted to the rotationally movable part (the first section 143) of the leaf spring 141. Differently stated, the leaf spring 141 includes the third section 145 that extends in a horizontal direction that is orthogonal relative to the vertical direction and is rigidly secured in position and the first section 143 that extends in the vertical direction and is rotationally movable and the sealing member 142 is fitted to the first section 143. The first section 143 and the second section 144 jointly rotate around a point located in the vicinity of the connection point of the second section 144 and the third section 145 and the sealing member 142 that is fitted to the first section 143 is pressed against the air intake hole 131 to close the air intake hole 131. Meanwhile, as the first section 143 is driven to rotate so as to come close to the third section 145, the sealing member 142 moves away from the air intake hole 131 to get to a position that allows the air intake hole 131 to become open. In this way, in response to a rotary motion of the leaf spring 141, the sealing member 142 becomes rotationally movable between the position where it abuts the air intake hole 131 and closes the air intake hole 131 (see FIG. 3A) and the position where it is separated from the air intake hole 131 to allow the air intake hole 131 to become open (see FIG. 3B). In other words, the air intake hole 131 is opened and closed as the leaf spring 141 rotates.

Figure 4:
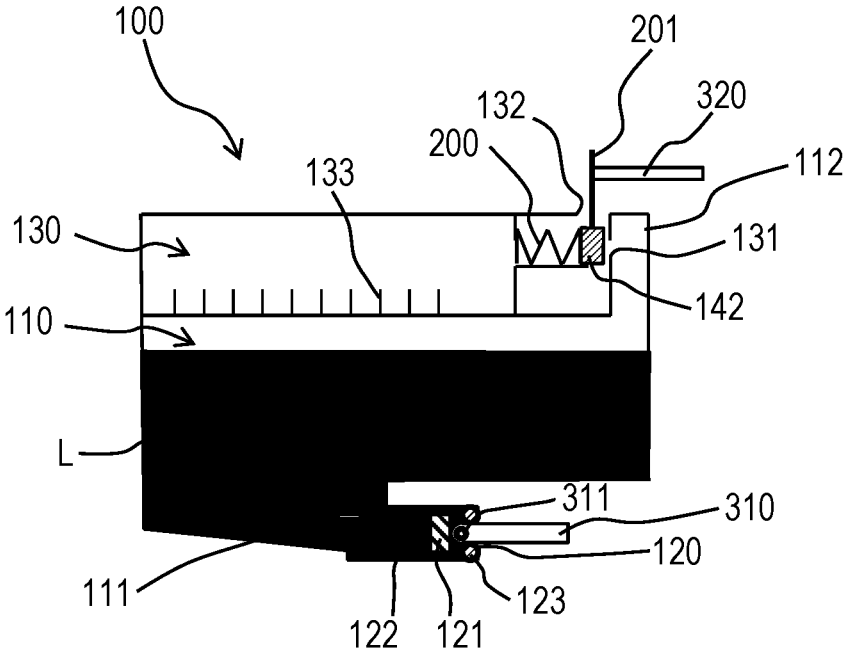
FIG. 4 is a schematic cross-sectional view of a known liquid tank, shown as a reference example.

In the instance of the reference example shown in FIG. 4, the urging member that presses the sealing member 142, which operates to close the air intake hole 131, is a coil spring 200 and the sealing member 142 is urged by the coil spring 200 to move back and forth so as to open and close the air intake hole 131. In the instance of this reference example, the direction in which the pressing portion 320 applies force to press the sealing member 142 by way of the abutment section 201 and the direction of the urging force of the coil spring 200 run in parallel but oppositely relative to each other. Unless the force that the pressing portion 320 applies to press the sealing member 142 exceeds the urging force of the coil spring 200, the air intake hole 131 remains closed. In other words, the pressing portion 320 needs to be so designed as to apply force to the sealing member 142 that is greater than the urging force of the coil spring 200.

On the other hand, according to the present disclosure, the sealing member 142 can be moved away from the air intake hole 131 by making the leaf spring 141 rotate as described earlier. More specifically, the pressing portion 320 applies force to press the sealing member 142 in the direction that is orthogonal relative to the surface where the sealing member 142 is arranged, whereas the direction in which the leaf spring 141 exerts its urging force agrees with the direction in which the leaf spring 141 rotates around a point located in the vicinity of the connection point of the second section 144 and the third section 145. The leaf spring 141 rotates around a point located in the vicinity of the connection point of the second section 144 and the third section 145 and the first section 143 presses the sealing member 142 against the air intake hole 131. Therefore, the distance between the point located in the vicinity of the connection point of the second section 144 and the third section 145 around which the leaf spring 141 rotates and the part of the first section 143 of the leaf spring 141 where the sealing member 142 is fitted and that corresponds to the point of effort when the leaf spring 141 operates as lever can be increased to in turn give rise to a large moment. Then, with the above-described arrangement, the sealing member 142 can be moved away from the air intake hole 131 to open the air intake hole 131 with an amount of force that is smaller than the amount of force with which the sealing member 142 is pressed against the air intake hole 131. Furthermore, it is not necessary to entirely move the sealing member 142 away from the air intake hole 131. In other words, the liquid storage chamber 110 and the air communication chamber 130 can be brought into communication with each other by moving only part of the sealing member 142 away from the air intake hole 131. Then, as a result, air can be taken into the liquid storage chamber 110 by way of the air communication port 132, the air communication chamber 130 and the air intake hole 131. Thus, according to the present disclosure, as described above, since the air intake hole 131 is opened and closed by means of the sealing member 142 and rotary motions of the leaf spring, part of the sealing member 142 can be moved away from the air intake hole 131 with a relatively small amount of force. In other words, the operation of opening the air intake hole 131 does not require any significant force and hence the force required to mount the liquid tank 100 into the liquid ejection apparatus can significantly be reduced.

Figure 5A:
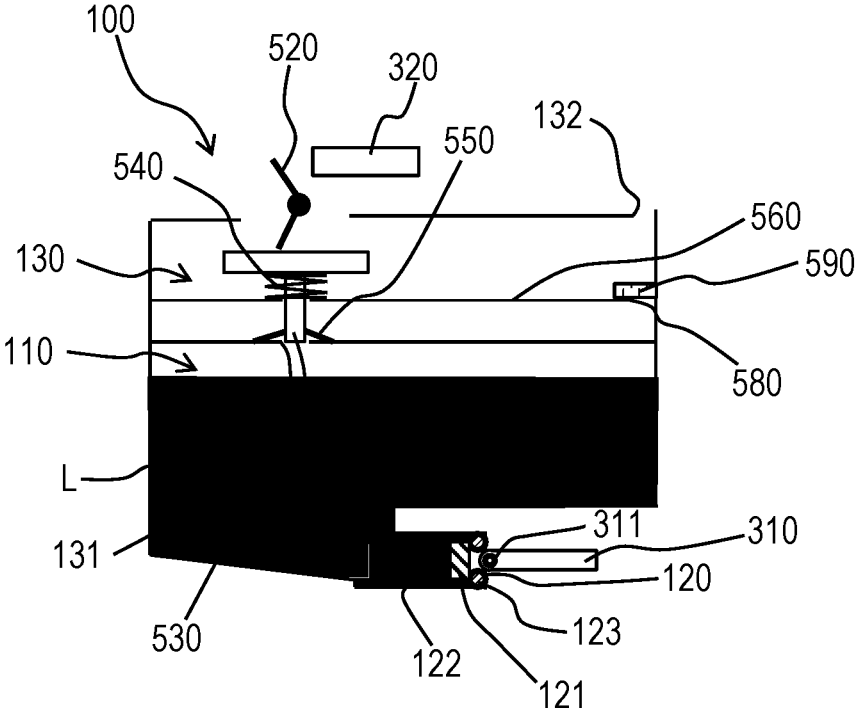
FIGS. 5A and 5B are schematic cross-sectional views of another known liquid tank shown as another reference example, illustrating the sequence in which it is fitted to a liquid ejection head.
Figure 5B:
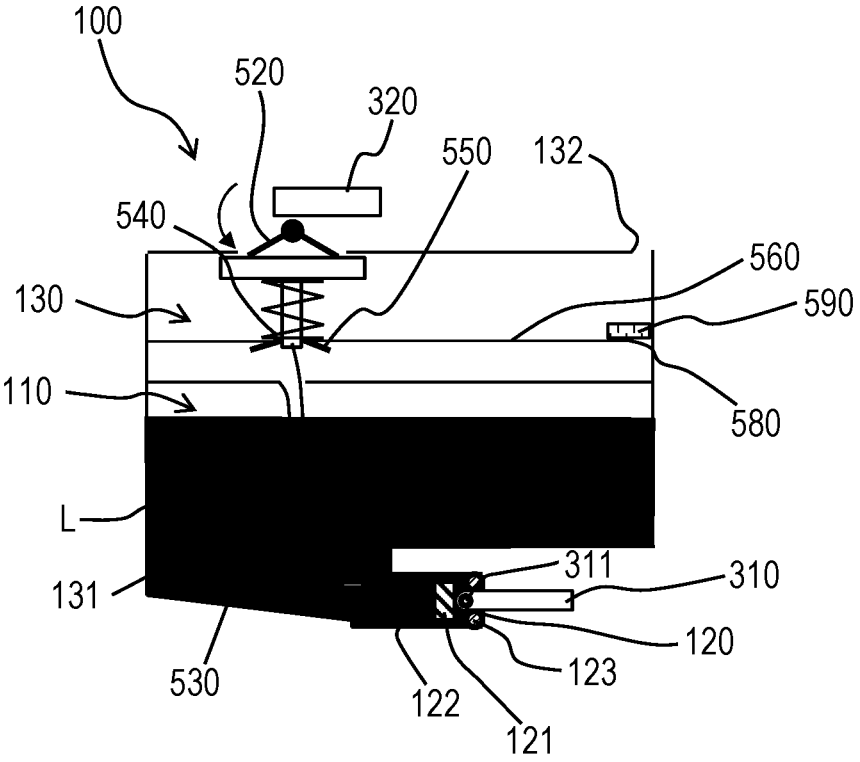

FIGS. 5A and 5B show another reference example having an arrangement similar to that of the disclosure of Japanese Patent Application Laid-Open No. 2018-161876. FIG. 5A is a schematic cross-sectional view of the liquid tank 100 of the reference example immediately before the pressing portion 320 of the holder 3 is made to abut the lever 520 of the liquid tank 100 in the process of mounting the liquid tank 100 into the holder 3. FIG. 5B is a schematic cross-sectional view of the liquid tank 100 when the operation of mounting the liquid tank 100 into the holder 3 is completed. In this reference example, before the liquid tank 100 is mounted into the apparatus body, the valve body 530 that includes the sealing member 550 is urged by a coil spring 540 so as to close the air intake hole 131. More specifically, the lever 520 that is made to partly abut the valve body 530 presses down the valve body 530 against the urging force of the coil spring 540 and presses the sealing member 550 around the air intake hole 131 to consequently close the air intake hole 131.

In the process of mounting the liquid tank 100 into the apparatus body, the pressing portion 320 of the apparatus body abuts the lever 520 to rotate the lever 520 and change the posture of the lever 520. Then, as a result, the extent to which the lever 520 presses down the valve body 530 is reduced and the valve body 530 is made to raise its position by the urging force of the coil spring 540. Consequently, the sealing member 550 is moved away from the air intake hole 131 to open the air intake hole 131. In this way, the liquid storage chamber 110 is brought into communication with the air communication chamber 130 by way of the air intake hole 131. Thus, the liquid storage chamber 130 is made to be able to take outer air into it by way of the air communication port 132, the air communication chamber 130 and the air intake hole 131. However, in the instance of this reference example, the air intake hole 131 is left wide open when the liquid tank 100 is removed from the apparatus body. Therefore, once the liquid tank 100 is removed from the apparatus body, the liquid in the inside of the liquid storage chamber 110 becomes liable to get into the air communication chamber 130. In view of this drawback, the air communication chamber 130 is divided into two smaller chambers by a partition wall 560, which partition wall 560 is provided with a hole 580, so as to prevent the liquid that gets into the air communication chamber 130 from the air intake hole 131 that is held open does not leak out to the outside. Then, a gas-liquid separation membrane 590 is fitted to the hole 580 running through the partition wall 560. Thus, the liquid tank 100 of the reference example has a large number of component parts to make the process of assembling the liquid tank 100 a complex one and raise the cost of manufacturing the liquid tank 100.

To the contrary, according to the present disclosure, once the liquid tank 100 is removed from the holder 3 of the apparatus body, the sealing member 142 is brought to the position where it is forced to abut and close the air intake hole 131 by the urging force of the leaf spring 141. Therefore, the liquid in the liquid storage chamber 110 is prevented from getting into the air communication chamber 130 and, in turn, the liquid is prevented from flying away or leaking out to the outside of the liquid tank 100. In the process of mounting the liquid tank 100 into the apparatus body, the leaf spring 141 is pressed by the pressing portion 320 arranged in the holder 3 of the apparatus body and consequently forced to rotate against the urging force. The sealing member 142 is forced to rotate with the leaf spring 141 and moved to the position where it is separated from the air intake hole 141 so as to make the air intake hole 141 wide open. With the above-described arrangement, the liquid tank 100 has only a small number of component parts to make the process of assembling the liquid tank 100 an easy one and reduce the cost of manufacturing the liquid tank 100. Additionally, as pointed out earlier, when the liquid tank 100 is removed from the apparatus body, the air intake hole 131 remains closed to prevent the liquid in the inside of the liquid storage chamber 110 from flying away or otherwise leaking out. No significant force is required to rotate the leaf spring 141 and the air intake hole 131 can be opened and closed by driving the leaf spring 141 to rotate so that the liquid tank 100 can be mounted into and dismounted from the holder 3 of the apparatus body without requiring any significant force.

Second Embodiment

Figure 6A:
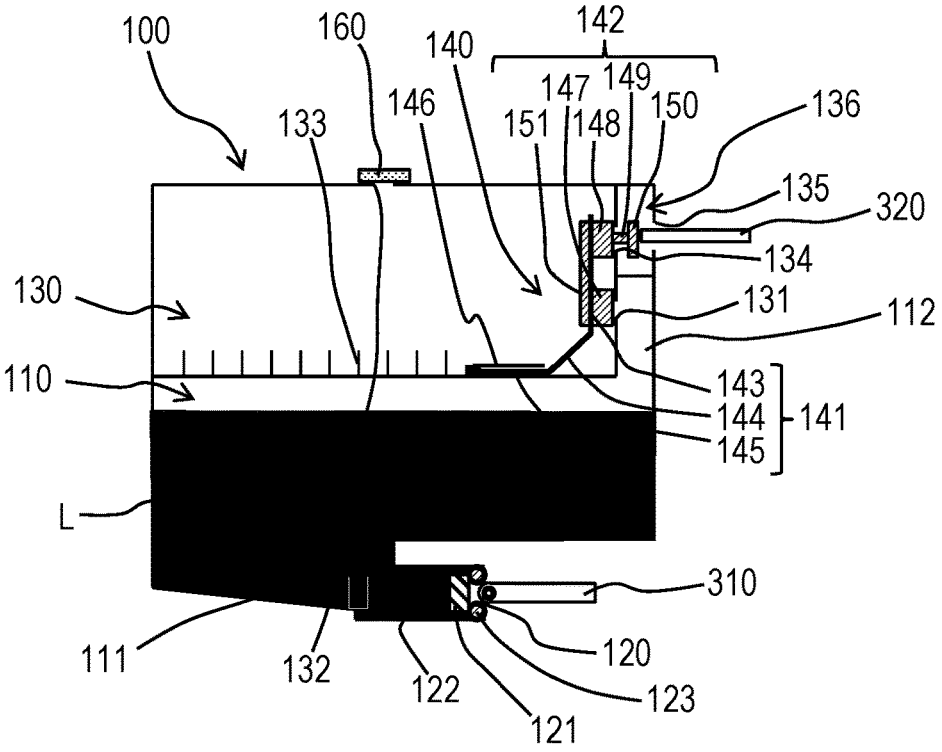
FIGS. 6A and 6B are schematic cross-sectional views of the second embodiment of liquid tank according to the present invention, illustrating the sequence in which it is fitted to a liquid ejection apparatus.
Figure 6B:
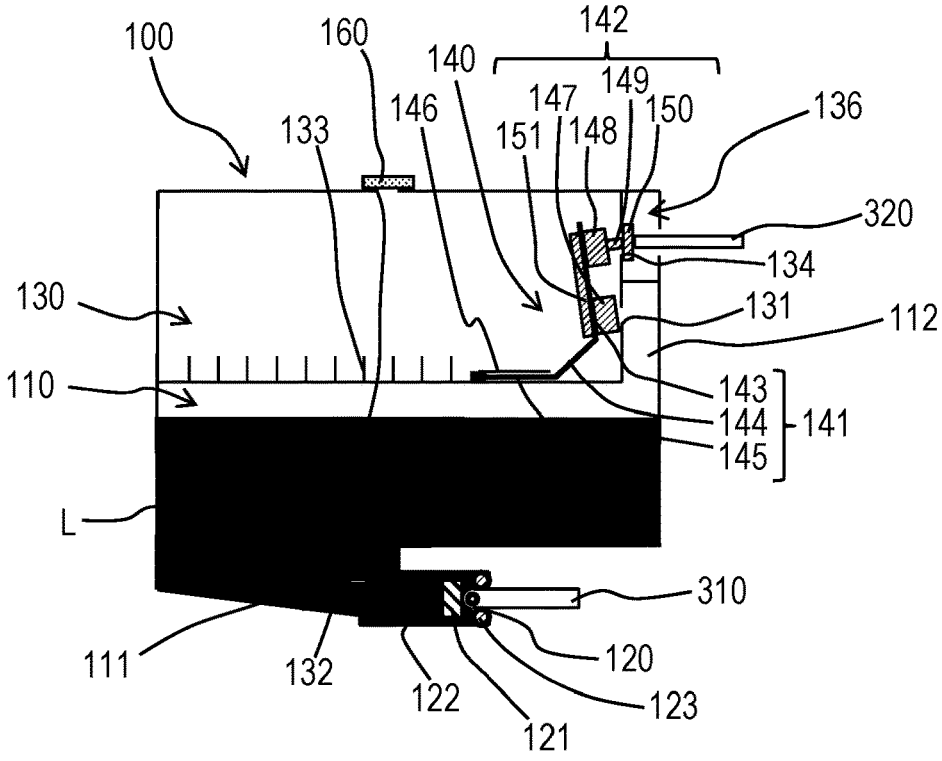

Now, the second embodiment of the present disclosure will be described below by referring to FIGS. 6A and 6B. FIGS. 6A and 6B are schematic cross-sectional views showing only the liquid tank 100 and the joint needle 310 and the pressing portion 320 of the holder 3 to illustrate the operation of mounting the liquid tank 100 into the holder 3. More specifically, FIG. 6A is a schematic cross-sectional view of the liquid tank 100 immediately before the pressing portion 320 of the holder 3 abuts the leaf spring 141 of the liquid tank 100 in the process of mounting the liquid tank 100 into the holder 3. FIG. 6B is a schematic cross-sectional view of the liquid tank 100 that is completely mounted into the holder 3. The second embodiment differs from the first embodiment in terms of the configuration of the air communication chamber 130 and the component parts surrounding the air communication chamber 130 and hence only the difference and the effect of the difference will be described below. Otherwise, the second embodiment is substantially identical with the first embodiment and hence the remaining component parts of the second embodiment will not be described below any further.

The liquid tank 100 of this embodiment is provided with a pressing portion receiving space 136 at a position in the holder 3 that is located next to the air communication chamber 130 and faces the pressing portion 320 of the holder 3. In other words, the pressing portion receiving space 136 is located right above the protruding part 112 of the liquid storage chamber 110 as viewed in the vertical direction. The pressing portion receiving space 136 is provided with a first opening 134 at a position located above the air intake hole 131 as viewed in the vertical direction. The pressing portion receiving space 136 is a space partitioned and separated from the air communication chamber 130. The pressing portion receiving space 136 is held in communication with the air communication chamber 130 by way of the first opening 134. The pressing portion receiving space 136 is also provided with a second opening 135 that is open to the outside of the liquid tank 100. The first opening 134 and the second opening 135 are arranged on the same level as viewed in the vertical direction and located vis-à-vis relative to each other with the internal space of the pressing portion receiving space 136 interposed between them. The air communication port 132 of the liquid tank 100 of this embodiment is arranged at or near the center of the upper surface (ceiling wall) of the liquid tank 100. A gas-liquid separation membrane 160 is fitted to the air communication port 132.

The valve unit 140 of the liquid tank 100 of this embodiment includes a leaf spring 141 similar to the leaf spring 141 of the first embodiment and a sealing member 142 is fitted to the first section 143 of the leaf spring 141. The sealing member 142 includes a first seal section 147 and a second seal section 148. Like the sealing member 142 of the first embodiment, the first seal section 147 is arranged at a position that faces the air intake hole 131 and is located between the liquid storage chamber 110 and the air communication chamber 130. The second seal section 148 is located at a position that faces the first opening 134 and is located between the air communication chamber 130 and the pressing portion receiving space 136. The two seal sections 147 and 148 are connected to each other by means of a connecting section 151. The connecting section 151 of the first seal section 147 and the second seal section 148 is located in the inside of the air communication chamber 130. More specifically, the connecting section 151 is arranged at a position where it interferes neither with the surface where the air intake hole 314 is arranged nor with the surface where the first opening 134 is arranged.

A linear section 149 is arranged at the second seal section 148 and a flange section 150 is arranged at the front end of the linear section 149. The linear section 149 runs through the first opening 134. The second seal section 148 is arranged in the inside of the air communication chamber 130 along with the first seal section 147 and the connecting section 151, whereas the flange section 150 is arranged in the inside of the pressing portion receiving space 136. Thus, the flange section 150 that is located in the inside of the pressing portion receiving space 136 is linked to the second seal section 148 by way of the linear section 149 that runs through the first opening 134. Therefore, the second seal section 148 and the flange section 150 can integrally move in a direction that substantially runs in parallel with the direction in which the first opening 134 opens within the range of the length of the linear section 149. The sealing member 142 of this embodiment is a member that is realized by integrally forming the above-described component parts including the first seal section 147, the second seal section 148, the connecting section 151, the linear section 149 and the flange section 150 and the sealing member 142 is fitted to the leaf spring 141.

Before the liquid tank 100 is fitted to the apparatus body, the air intake hole 131 is closed by the first seal section 147 of the leaf spring 141 and the first opening 134 is closed by the second seal section 148 of the leaf spring 141 as shown in FIG. 6A. Therefore, the liquid storage chamber 110, the air communication chamber 130 and the pressing portion receiving space 136 would never be brought into communication with each other and hence they remain as so many independent spaces.

When the liquid tank 100 is mounted into the holder 3 of the apparatus body, the pressing portion 320 of the holder 3 gets into the pressing portion receiving space 136 through the second opening 135. Then, the pressing portion 320 comes to abut the flange section 150 in the inside of the pressing portion receiving space 136. As the liquid tank 100 is brought further into the holder 3, the pressing portion 320 comes to press the first section 143 of the leaf spring 141 by way of the flange section 150, the liner section 149 and the second seal section 148 as shown in FIG. 6B. The leaf spring 141 that is pressed by the pressing portion 320 is forced to rotate around a point located in the vicinity of the connection point of the second section 144 and the third section 145 as in the instance of the first embodiment. Then, as a result, the first seal section 147 of the sealing member 142 that is fitted to the first section 143 is moved away from the air intake hole 131. As the air intake hole 131 is opened in this way, the liquid storage chamber 110 is brought into communication with the air communication chamber 130 by way of the air intake hole 131. Then, air can be taken into the liquid storage chamber 110 by way of the gas-liquid separation membrane 160 fitted to the air communication port 132, the air communication chamber 130 and the air intake hole 131. On the other hand, although the second seal section 148 is moved away from the first opening 134, the flange section 150 immediately closes the first opening 134 and hence the first opening 134 remains closed. Therefore, the air communication chamber 130 and the pressing portion receiving space 136 are never brought into communication with each other. Thus, after the air intake hole 131 is opened and the liquid storage chamber 110 and the air communication chamber 130 are brought into communication with each other, the liquid storage chamber 110 and the tube 2 are made to communicate with each other by means of the joint needle 310 that is put into the liquid supply port 120 as in the instance of the first embodiment. Then, as a result, liquid can be supplied from the liquid tank 100 to the liquid ejection head 1 by way of the joint needle 310 and the tube 2.

Thus, in this embodiment, as the pressing portion 320 is made to indirectly press the leaf spring 141, the leaf spring 141 is driven to rotate and consequently the sealing member 142 is forced to rotate to alternatively take the two positions that will be described below. When the leaf spring 141 is not pressed by the pressing portion 320, the first seal section 147 of the sealing member 142 is placed at the position where it abuts the air intake hole 131 and closes the air intake hole 131, while the second seal section 148 is placed at the position where it abuts the first opening 134 and closes the first opening 134. As the pressing portion 320 presses the leaf spring 141, the first seal section 147 of the sealing member 142 is moved away from the air intake hole 131 to the position where it frees the air intake hole 131. At this position, the second seal section 148 is moved away from the first opening 134 but the flange section 150 comes to abut the first opening 134 and close the first opening 134. Therefore, in response to a rotary motion of the leaf spring 141, the sealing member 142 can take either the position where it closes both the air intake hole 131 and the first opening 134 or the position where it opens the air intake hole 131 but closes the first opening 134.

In this embodiment, the leaf spring 141 does not project to the outside of the liquid tank 100 but is contained in the inside of the liquid tank 100. Therefore, in a condition where the liquid tank 100 is not fitted to the holder 3, if the liquid tank is turned upside down and inadvertently dropped to make the top of the liquid tank 100 touch the ground first, no impact is directly applied to the leaf spring 141. Thus, the risk that the leaf spring 141 is bent by an impact so as not to operate properly any longer is minimized. Then, as a result, the risk that the air intake hole 131 is unintendedly opened to allow the liquid in the liquid storage chamber 110 to get into the air communication chamber 130 can also be minimized.

If the posture of the apparatus body is changed after the liquid tank 100 is mounted into the holder 3 as shown in FIG. 6B and the liquid in the liquid storage chamber 110 is allowed to get into the air communication chamber 130 by way of the air intake hole 131, the first opening 134 is tightly closed by the flange section 150. Therefore, the liquid that gets into the air communication chamber 130 is prevented from entering the pressing portion receiving space 136 and hence the liquid in the liquid tank 100 would never fly away or otherwise leak out to the outside by way of the second opening 135. Furthermore, since the air communication port 132 is arranged at a position greatly separated from the air intake hole 131, the liquid that enters the air communication chamber 130 from the air intake hole 131 can hardly get to the air communication port 132. Additionally, since the air communication port 132 is equipped with a gas-liquid separation membrane 160, if the liquid gets to the air communication port 132, the risk that the liquid flies away or otherwise leaks out to the outside of the liquid tank 100 is minimized.

Thus, the present disclosure provides a liquid container that minimizes the risk that the liquid contained in the liquid container flies away or otherwise leaks out to the outside by way of the air communication port. Additionally, a liquid container and a liquid ejection apparatus according to the present disclosure can be manufactured in a simple manner at low manufacturing cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-162079, filed Sep. 28, 2020, which is hereby incorporated by reference herein in its entirety.

What is claimed is:

1. A liquid container removably mountable into the apparatus body of a liquid ejection apparatus, the liquid container comprising:

a liquid storage chamber equipped with an air intake hole and a liquid supply port, for storing liquid; and a valve unit having a sealing member and an urging member;

the urging member being arranged so as to be at least partly rotationally movable, the urging member having urging force for urging the sealing member in the direction of making the sealing member abut the air intake hole;

the sealing member being rotationally movable between a position of abutting and closing the air intake hole and a position separated from the air intake hole so as to open the air intake hole in response to a rotary motion of the urging member.

2. The liquid container according to claim 1, wherein the sealing member is placed at a position where it abuts the air intake hole and closes the air intake hole by the urging force of the urging member when the liquid container is not fitted to the apparatus body; and, in the process of mounting the liquid container into the apparatus body, at least part of the urging member is forced to rotate against the urging force of the urging member and the sealing member is made to rotate with the urging member and move to a position separated from the air intake hole so as to open the air intake hole.

3. The liquid container according to claim 2, wherein, in the process of mounting the liquid container into the apparatus body, the urging member is pressed by a pressing portion arranged in the apparatus body so as to be forced to rotate against the urging force.

4. The liquid container according to claim 1, wherein the urging member is a leaf spring having a part thereof rigidly secured in position and the remaining part thereof held rotationally movable and the sealing member is fitted to the rotationally movable part of the urging member.

5. The liquid container according to claim 4, wherein the urging member has a surface that extends in a direction that is orthogonal relative to the vertical direction and is rigidly secured to the liquid container body and a surface that extends in the vertical direction and is rotationally movable and the sealing member is fitted to the surface of the urging member that extends in the vertical direction and is rotationally movable.

6. The liquid container according to claim 5, wherein the sealing member is moved away from the air intake hole to a position that allows the air intake hole to become open as a result of that the surface of the urging member that extends in the vertical direction and is rotationally movable is forced to rotate to come close to the surface of the urging member that extends in a direction that is orthogonal relative to the vertical direction and is rigidly secured to the liquid container body.

7. The liquid container according to claim 1, further comprising an air communication chamber equipped with an air communication port, the air communication port being open to the outside, the liquid storage chamber and the air communication chamber being held in communication with each other by way of the air intake hole, the valve unit being arranged in the inside of the air communication chamber.

8. The liquid container according to claim 7, wherein the liquid storage chamber includes a protruding part projecting upward in the vertical direction and the air communication chamber and the protruding part are arranged side by side, whereas the air intake hole is arranged between the air communication chamber and the protruding part.

9. The liquid container according to claim 7, wherein the air communication port and the air intake hole are arranged at the respective walls of the walls that defines the air communication chamber.

10. The liquid container according to claim 9, wherein the air communication port is arranged at a position located on the air communication chamber as viewed in the vertical direction of the wall extending in directions orthogonal relative to the vertical direction and the air intake hole is arranged at one of the walls of the air communication chamber that extend in the vertical direction.

11. The liquid container according to claim 7, further comprising:

a pressing portion receiving space, the air communication chamber and the pressing portion receiving space being held in communication with each other by way of a first opening;

the sealing member including a first seal section capable of abutting the air intake hole and a second seal section capable of abutting the first opening, the first seal section and the second seal section being arranged in the inside of the air communication chamber;

the sealing member being rotationally movable between a position for the first seal section of the sealing member to abut the air intake hole and close the air intake hole and for the second seal section of the sealing member to abut the first opening and close the first opening and a position for the first seal section to be moved away from the air intake hole and open the air intake hole and for the second seal section to be moved away from the first opening in response to a rotary motion of the urging member.

12. The liquid container according to claim 11, wherein a flange section is arranged in the inside of the pressing portion receiving space and linked to the second seal section by way of a linear section running through the first opening; and the first seal section is adapted to be moved away from the air intake hole and open the air intake hole, whereas the flange section is adapted to abut the first opening and closes the first opening when the second seal section is located as a position separated from the first opening.

13. The liquid container according to claim 12, wherein the pressing portion receiving space has a second opening located at a position facing the first opening with the inner space of the pressure portion receiving space interposed between the first opening and the second opening; and, in the process of mounting the liquid container into the apparatus body, the urging member is forced to rotate against the urging force as the pressing portion arranged at the apparatus body is made to run through the second opening and abut the flange section so as to press the urging member by way of the flange section, the linear section and the second seal section.

14. The liquid container according to claim 11, wherein the pressing portion receiving space is arranged right above the liquid storage chamber as viewed in the vertical direction and the first opening is located at a position right above the air intake hole as viewed in the vertical direction.

15. A liquid ejection apparatus comprising:

a liquid container according to claim 1, a holder arranged at the apparatus body so as to receive the liquid container in the inside thereof and a liquid ejection head;

the holder having a pressing portion for pressing the urging member in the process of mounting the liquid container into the apparatus body and a joint needle to be put into the liquid supply port in the process of mounting the liquid container into the apparatus body;

the liquid ejection head being connected to the joint needle by way of a tube.

* * * * *